US006155536A

United States Patent [19]

Digman

[11] Patent Number: 6,155,536

[45] Date of Patent: Dec. 5, 2000

[54] HYDRAULIC STAGING JACK

[75] Inventor: Micah L. Digman, Milwaukee, Wis.

[73] Assignee: Applied Power Inc., Butler, Wis.

[21] Appl. No.: 08/931,334

[22] Filed: Sep. 16, 1997

[51] Int. Cl.[7] ..... B66F 3/24

[52] U.S. Cl. ..... 254/93 R; 254/100

[58] Field of Search ..... 254/93 H, 93 R, 254/133 R, 134, 100, 89 H

[56] References Cited

U.S. PATENT DOCUMENTS

| | | | |
|---|---|---|---|
| 3,709,467 | 1/1973 | Mann | 254/45 |
| 3,871,619 | 3/1975 | Simon | 254/93 R |
| 4,572,481 | 2/1986 | Chambers | 254/106 |
| 5,013,190 | 5/1991 | Green | 405/230 |

FOREIGN PATENT DOCUMENTS

| | | |
|---|---|---|
| 40116/89 | 2/1990 | Australia . |
| 503333 | 6/1920 | France . |
| 854045 | 4/1940 | France . |
| 2 388 760 | 11/1978 | France . |
| 27 46 610 | 4/1978 | Germany . |
| 1 422 200 | 1/1976 | United Kingdom . |

OTHER PUBLICATIONS

Applicant's Exhibit A—Jahns Structure Jacking Systems, Inc., P.O. Box J. Elburn,IL 60119; 14–page brochure, undated, admitted prior art.

Applicant's Exhibit B—Jahns Structure Jacking Systems, Inc., P.O. Box J. Elburn,IL 60119; 2–page flyer, undated, admitted prior art.

*Primary Examiner*—David A. Scherbel
*Assistant Examiner*—Benjamin M. Halpern
*Attorney, Agent, or Firm*—Quarles & Brady

[57] ABSTRACT

A hydraulic staging jack has a circumferentially grooved cylinder which fits into a base in which two shoes are seated and each shoe has two axially spaced flanges which engage in two axially spaced grooves of the cylinder. Radially outer surfaces of the shoes are axially angled so that moving the shoes axially out of the base causes the shoes to separate radially, thereby disengaging the flanges from the grooves and permitting adjustable axial fixing of the position of the cylinder relative to the base.

9 Claims, 5 Drawing Sheets

HYDRAULIC STAGING JACK

BACKGROUND OF THE INVENTION

1. Field of the Invention

This invention relates to hydraulic cylinder jacks, and in particular to hydraulic staging jacks.

2. Discussion of the Prior Art

Hydraulic staging jacks are well known. Such jacks are used for lifting, separating or any application of hydraulic force where the hydraulic force is applied by alternately jacking and cribbing. For example, when jacking up a building in preparation for moving the building, the hydraulic cylinder starts out at a relatively low position relative to a base with the base supported on supports (cribbing) and the cylinder pushing against I-beams on which the building is resting. The building is first jacked up a limited distance by applying hydraulic pressure to the cylinder and the building is blocked at that position. Cylinder pressure is then relieved and the operator moves the cylinder up in its base and fixes it at a new axial position relative to the base. Hydraulic pressure is then reapplied to the cylinder to once again extend the cylinder and move the building up higher. This cycle is repeated until the building reaches its desired height.

Prior art hydraulic staging jacks typically required the operator to operate two levers for engaging and disengaging the cylinder with the base. This was inconvenient and relatively difficult to do, and also permitted improper usage, since operators could lock the cylinder with only one lever.

SUMMARY OF THE INVENTION

The invention provides a hydraulic staging jack of the above described type in which the axial position of the cylinder relative to the base is easily adjusted and fixed. A flange is formed on a shoe which seats in the base so that moving the shoe axially out of the base disengages the flange radially from the groove. Seating the shoe axially in the base engages the flange radially in the groove.

Thus, with a jack of the invention, after the hydraulic pressure is relieved after one stage of a lifting operation is completed and the hydraulic pressure is relieved, the cylinder can be moved up to the next position for the next stage by simply lifting the cylinder up out of the base until the shoes engage the cylinder at the desired new position, and then reseating the cylinder in the base, with the shoes engaged with the cylinder at the new, lower position.

In a preferred form, two shoes are provided, and a handle is provided on at least one of the shoes for lifting the shoes up out of the base, to disengage them from the cylinder. The shoes are preferably engaged with each other so that they move together axially, but are free to move toward and away from one another in a radial direction.

These and other objects and advantages of the invention will be apparent from the detailed description and drawings.

DETAILED DESCRIPTION OF THE PREFERRED EMBODIMENT

Figure 1:
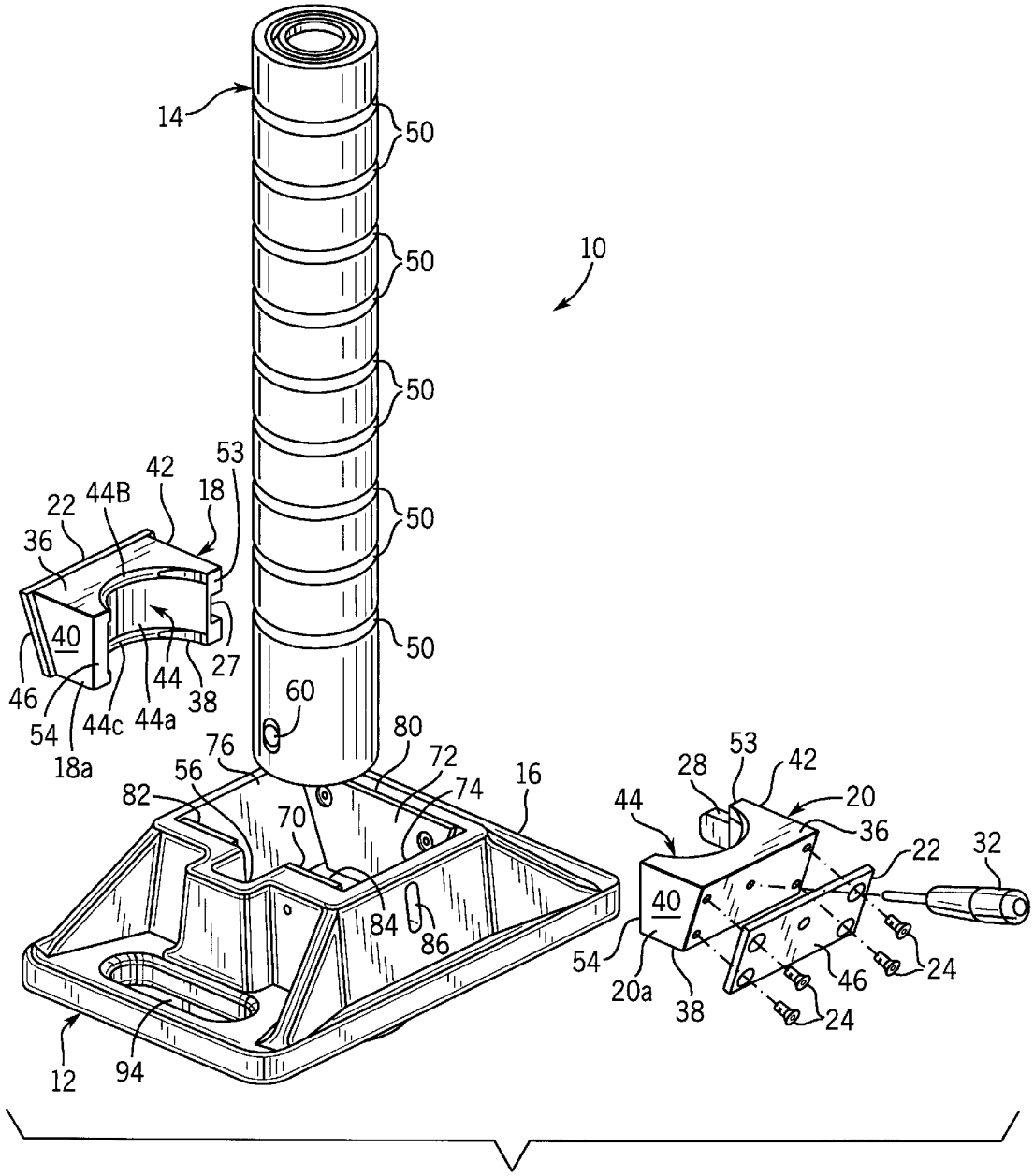
FIG. 1 is an exploded perspective view of a hydraulic staging jack of the invention.

Referring to FIG. 1, a hydraulic staging jack 10 of the invention includes a base 12 and a cylinder 14. The base 12 includes a foundation 16 and shoes 18 and 20. Each of the shoes 18 and 20 includes a retainer slide plate 22 which is secured by screws 24 to the respective shoe body 18*a* or 20*a*. An alignment key 28 is received in grooves formed in a side of each of the shoe bodies 18*a* and 20*a* and is secured to the shoe body 20*a* by a screw 30. All of the parts of the base 12 may be made out of steel, or to reduce weight the foundation 16 may be aluminum and the shoes 18 and 20 made of steel, along with parts such as the slide plates 22 and the key 28. The shoes could alternatively be made of aluminum and still meet and exceed ANSI jack standards.

Each shoe 18 and 20 has a top 36, a bottom 38, a left side 40, a right side 42, an inner side 44 and an outer side 46. The sides 40 and 42 are at right angles to the top 36 and to the bottom 38. The outer side 46 angles upwardly and outwardly relative to the top 36 and bottom 38.

The inside wall 44 of each shoe 18 and 20 has a concave central section 44*a*, which is generally cylindrical with an axis which is coaxial with the cylinder 14 when the shoes are seated in the foundation 16. Adjacent to its upper and lower edges the inside wall 44 is defined by flanges 44*b* and 44*c*. Each flange 44*b* and 44*c* has a half circular cross-section, except at its ends where it is flattened as shown at 48. The flanges 44*b* and 44*c* are flattened at their ends so that the flanges become disengaged from the grooves 50 at a lower height of the cylinder 14 relative to the foundation 16 when the cylinder 14 is pushed up in the foundation 16 to disengage the flanges 44*b* and 44*c* from the grooves 50.

Figure 5:
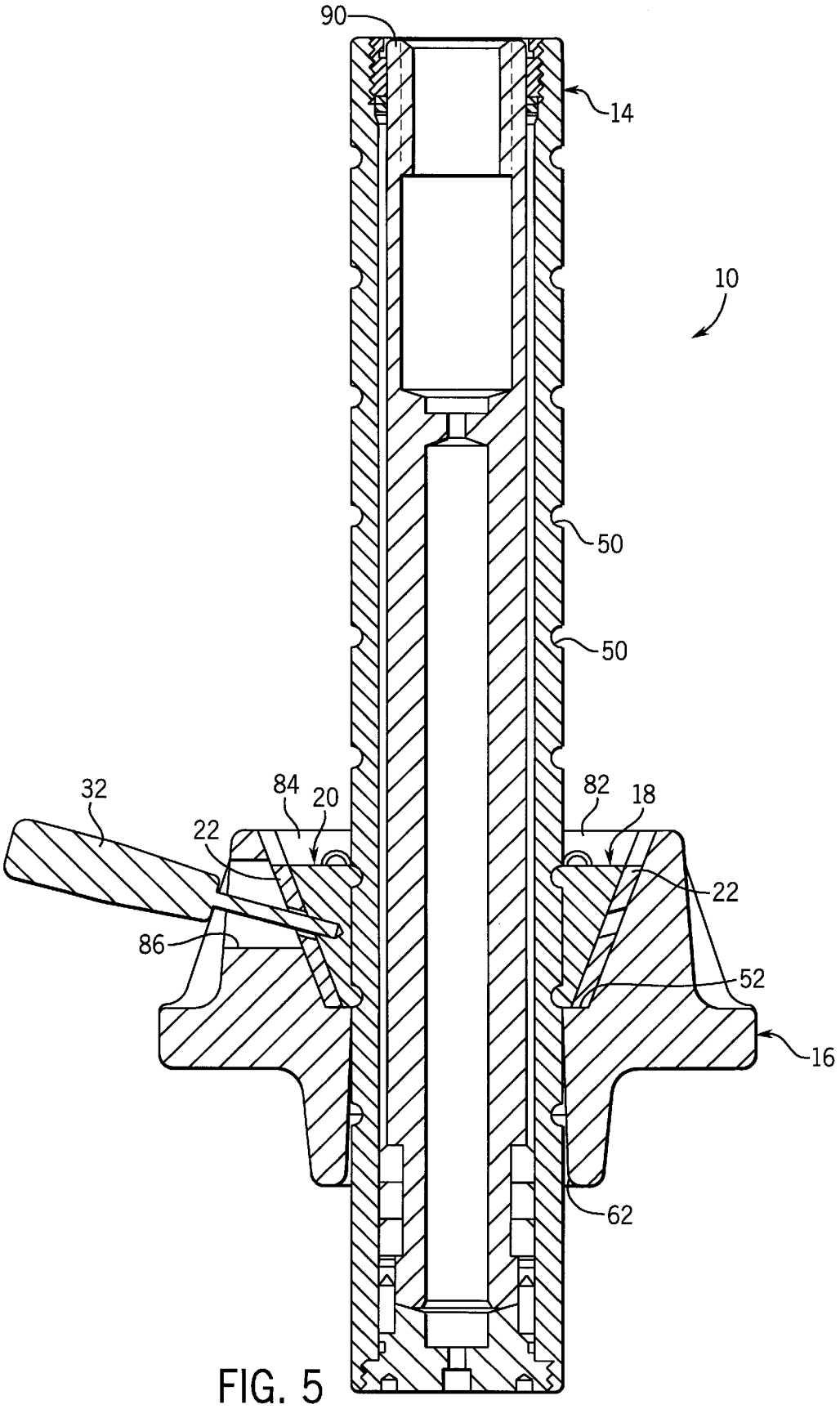
FIG. 5 is a cross-sectional view from the plane of the line 5—5 of FIG. 4.

The flanges 44*b* and 44*c* have a rounded cross-section so as to fit closely in and engage with semi-circular grooves 50 which are formed around the circumference of the cylinder 14. Each groove 50 extends all of the way around the cylinder 14 and is axially spaced from the adjacent grooves 50 by the same distance that the flanges 44*b* and 44*c* are axially spaced apart. Thus, the grooves 44*b* and 44*c* fit into a pair of grooves 50, as best shown in FIG. 5, when the shoes 18 and 20 are engaged with the cylinder 14. The grooves 50 are semi-circular so as to eliminate stress concentrations which are present with the typical square or rectangular cross-section grooves provided in such cylinders, which increases the capacity of the cylinder.

In this position, the shoes 18 and 20 abut and are supported on upwardly facing surface 52 which is formed in the foundation 16 and faces the bottom 38 of each shoe 18 and 20.

The inner side 44 of each shoe 18 and 20 also includes flat side faces 53 and 54. The faces 53 of the shoes 18 and 20 are in close face-to-face proximity to one another when the shoes 18 and 20 are seated on (and supported on) the surface 52. The surfaces 54 face each other but are spaced apart by a distance which is about equal to the width of groove 56 which is formed in the foundation 16. The space between the surfaces 54 and the space provided by the groove 56 provide a space for a hydraulic line (not shown) which may be provided on the outside of the cylinder 14 to run down to the cylinder port 60.

Figure 2:
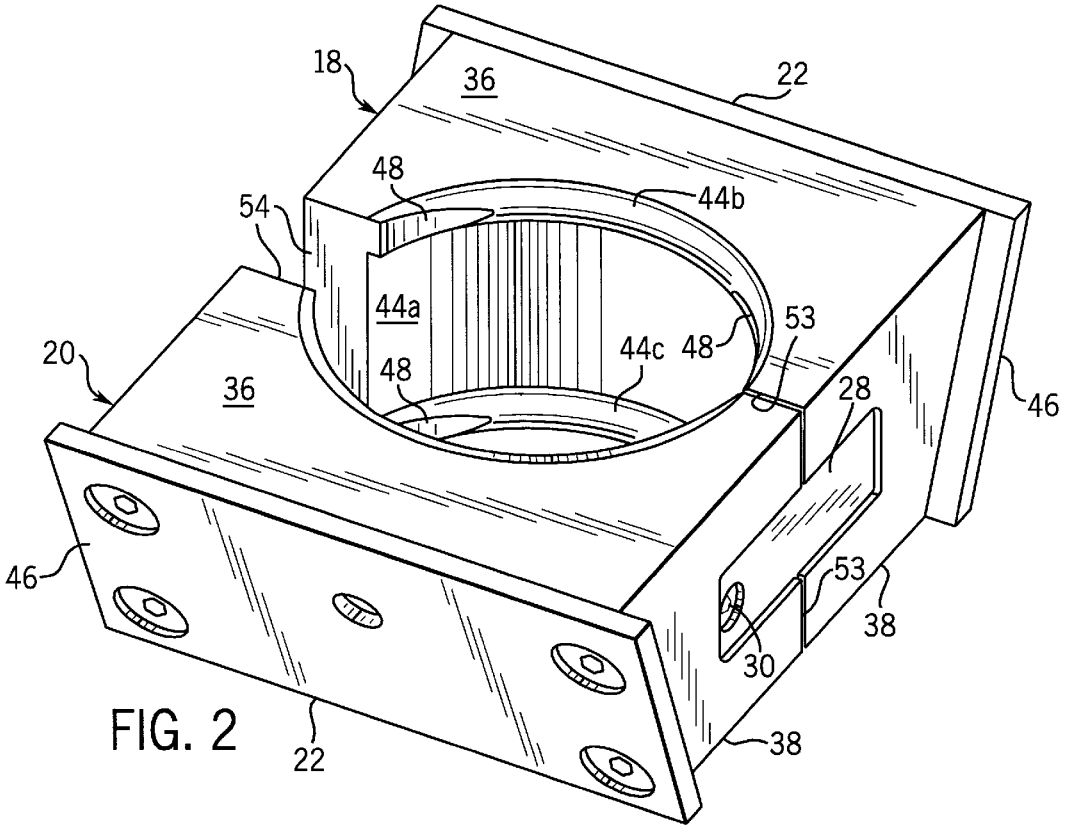
FIG. 2 is a perspective view of shoes for the staging jack of FIG. 1.
Figure 3:
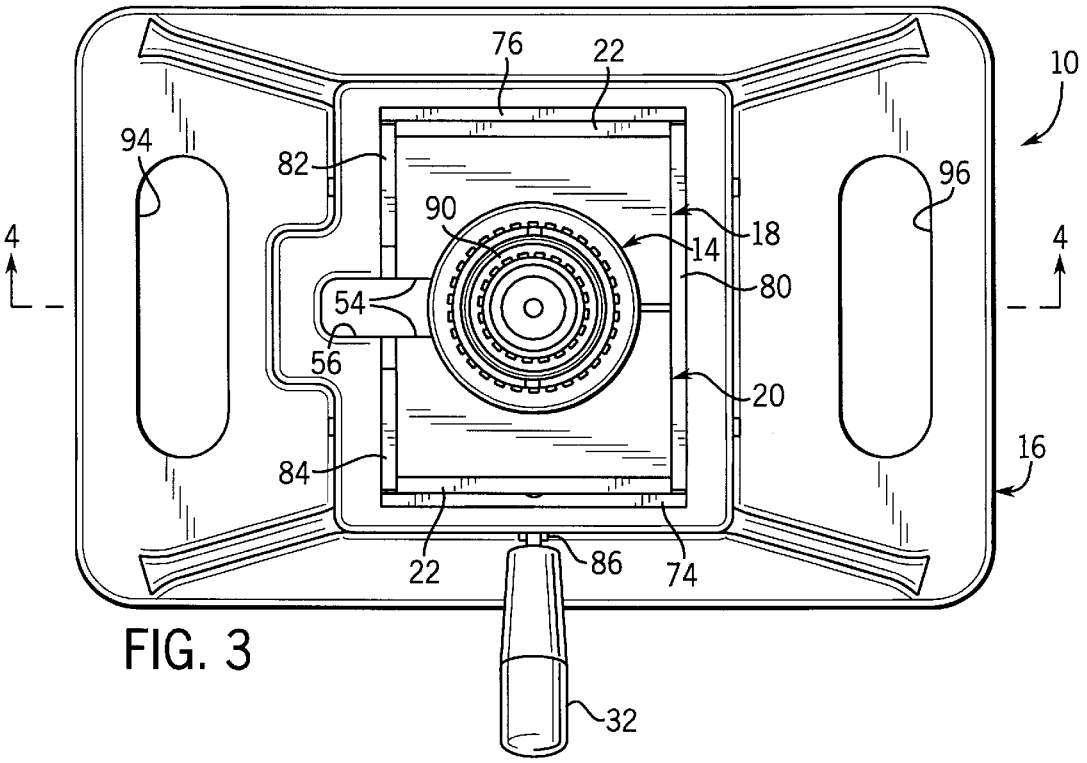
FIG. 3 is a top plan view of the jack of FIG. 1 shown assembled.
Figure 4:
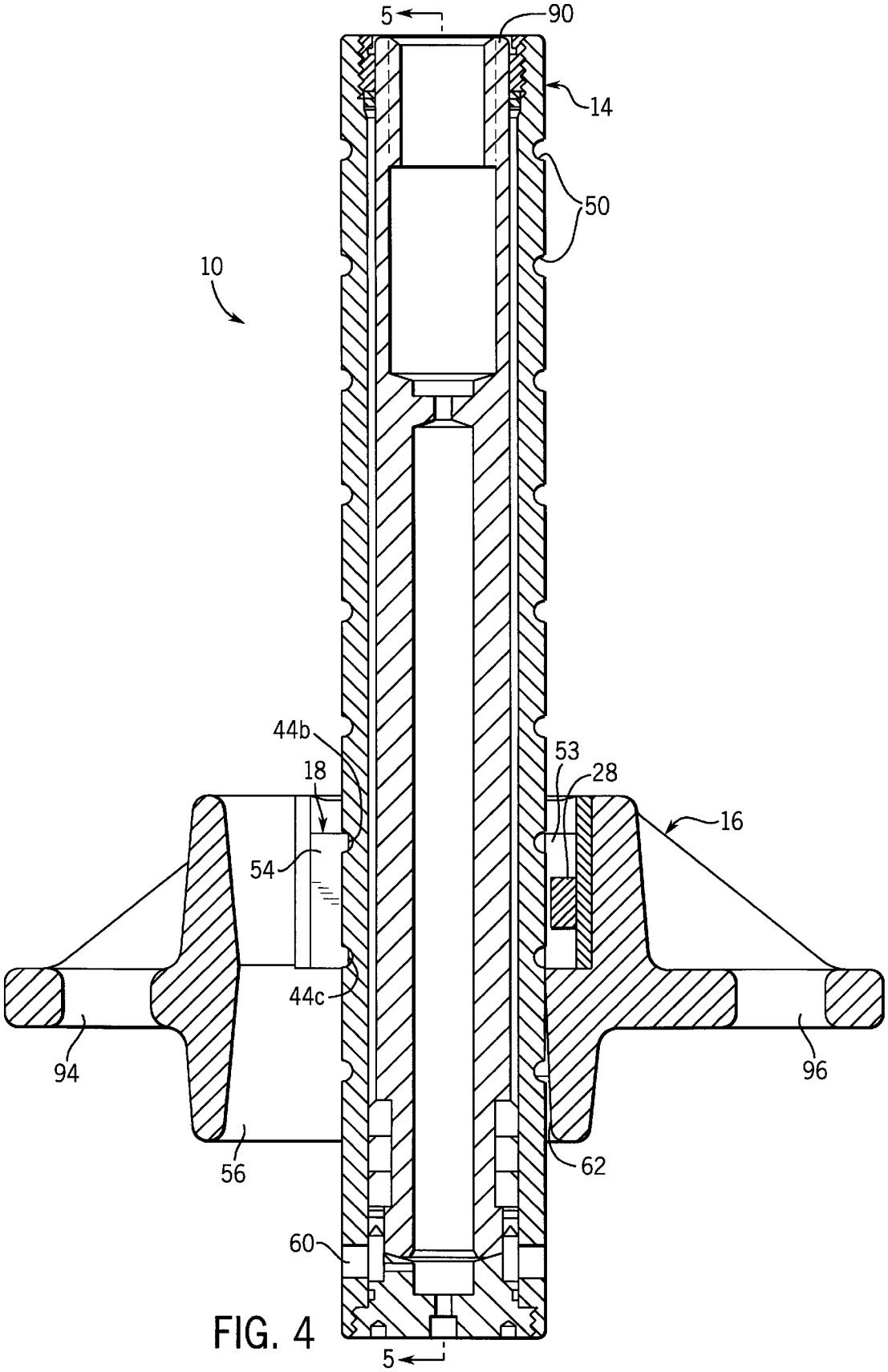
FIG. 4 is a cross-sectional view from the plane of the line 4—4 of FIG. 3.

The cavity of the foundation 16 in which the shoes 18 and 20 and the cylinder 14 is received is defined by a generally cylindrical guide hole 62 of slightly larger diameter than the cylinder 14 at the bottom end of the foundation 16. Groove 56 opens into the hole 62 as shown in FIG. 4. The lower end of the hole 60 preferably tapers outwardly so as to easily fit over the cylinder 14. Above the guide hole 62, the cavity is generally rectangular so as to receive the shoes 18 and 20 above the surface 52 and with the cylinder 14 between the shoes 18 and 20. The shape of the cavity above the hole 62 conforms to the shape of the shoes 18 and 20 when they are seated against the surface 52, having parallel side walls 70 and 72 (with side wall 70 split in the middle by groove 56) and upwardly diverging front and rear walls 74 and 76. Plates 80, 82 and 84 are bolted to the foundation 16 and form the side walls 72 and 70. The plates 72, 82 and 84 do not extend to the ends of the sidewalls 72 and 70 however, leaving spaces for the ends of the slide plates 22 to be received, which ends extend beyond the shoe bodies 18*a* and 20*a* as best shown in FIG. 2. Thus, when the shoes 18 and 20 are lifted above the surface 52, for example using the handle 32 which extends through elongated slot 86 formed in the foundation 16, the ends of each plate 22 which extend beyond the shoe bodies slide in the slots or ways defined between the ends of the plates 80, 82 and 84 and the adjacent front and rear walls 74 and 76.

Figure 6:
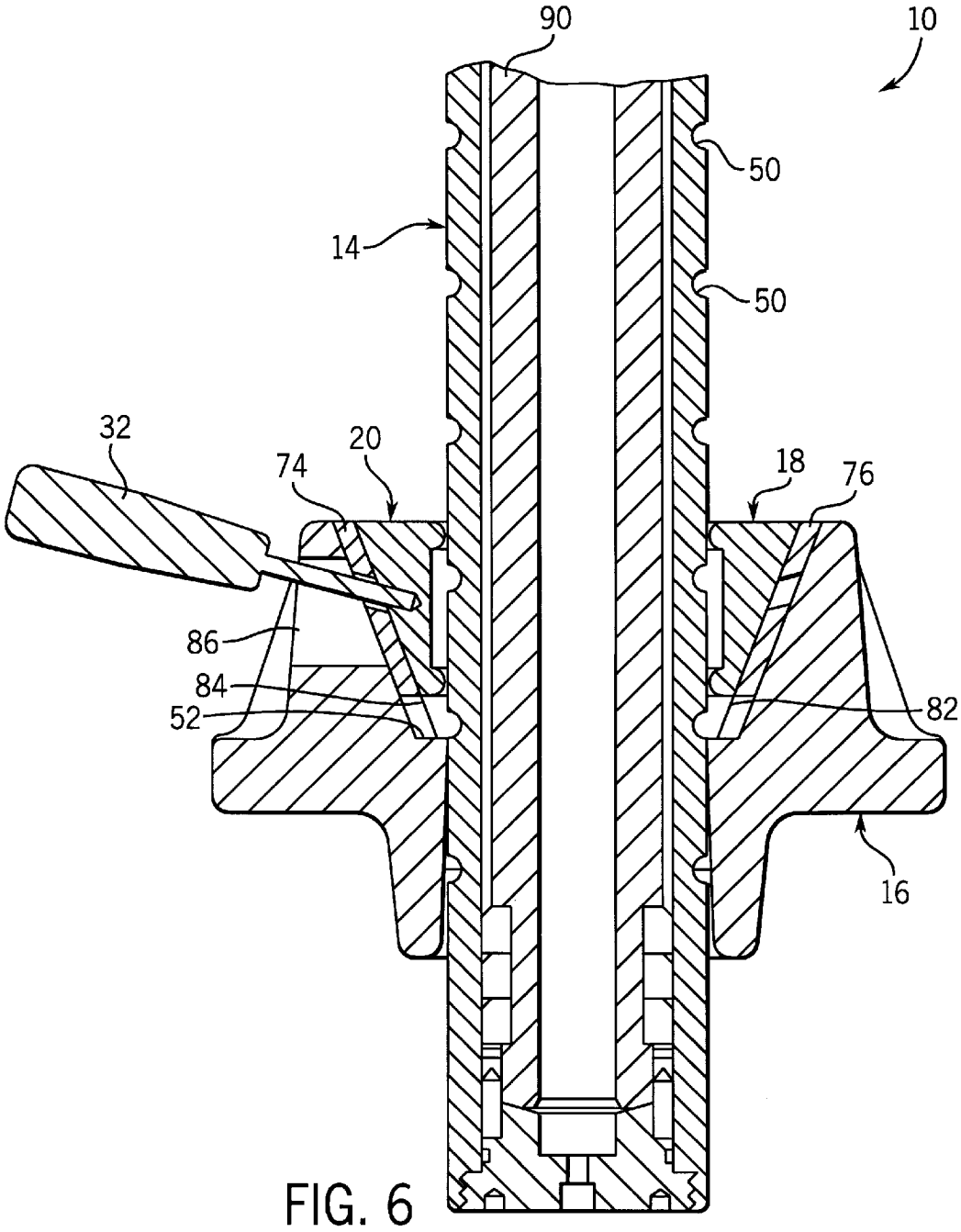
FIG. 6 is a fragmentary cross-sectional view similar to FIG. 5 but showing the shoes disengaged from the cylinder.

Thus, upward axial motion, i.e. lifting, of the shoes 18 and 20 causes them to separate radially, for example to go from the position shown in FIG. 5 to the position shown in FIG. 6. In the position shown in FIG. 6, the cylinder 14 can be raised or lowered relative to the base 12 and the flanges 44*b* and 44*c* reengaged with a different pair of grooves 50. Lifting the one shoe 20 by the handle 32 also lifts the other shoe 18, since alignment key 28 slides in the groove 27 of the shoe 18 permitting radial separation of the shoes 18 and 20 but maintaining them at the same axial position relative to one another.

The shoes 18 and 20 may be lifted and separated by pulling or pushing the cylinder 14 up also. Such pulling or pushing of the cylinder 14 upwardly raises the shoes 18 and 20 relative to the base 12 by virtue of the engagement between the grooves 50 and the flanges 44*b* and 44*c* until the flanges 44*b* and 44*c* become disengaged from the grooves 50. At that time, further pushing or pulling of the cylinder 14 upwardly causes the flanges 44*b* and 44*c* to slide along the cylindrical surfaces of the cylinder 14 which are between the grooves 50 until the flanges 44*b* and 44*c* engage in the next pair of grooves 50 down from the previously engaged pair. Further pushing or pulling of the cylinder 14 upwardly disengages the flanges 44*b* and 44*c* from the engaged pair of grooves 50 until the desired position of the cylinder 14 relative to the base 12 is obtained. At that time, with the flanges 44*b* and 44*c* engaged in the desired pair of adjacent grooves 50, the cylinder 14 is lowered until the shoes 18 and 20 seat against the surface 52, thereby locking the axial position of the cylinder 14 relative to the base 12.

As illustrated, the cylinder 14 is a single acting cylinder, having a piston rod 90 (shown with upper end open, although in use it is plugged). Any suitable type of cylinder could be used, whether single acting or double acting. However, the cylinder 14 does need to have grooves 50 formed in its outer surface, preferably grooves having a semicircular cross-section in conjunction with semicircular flanges 44*b* and 44*c*, which is the preferred shape for stress relief. Note that if the cylinder 14 is double acting and the upper end of the piston rod 90 is fixed to the workpiece being jacked up, retracting the cylinder will automatically move the cylinder 14 up relative to the base (if the base is held down from its own weight or by being clamped) and no manual moving of the cylinder 14 up in the base to the next higher position is necessary.

In addition, the foundation 16 is preferably formed with handle holds 94 and 96 for carrying of the base 12. The handle 32 and key 28 will keep the shoes 18 and 20 from falling out of the foundation 16, even in an inverted position.

Many modifications and variations to the preferred embodiment described will be apparent to those skilled in the art. Therefore, the invention should not be limited to the embodiment described, but should be defined by the claims which follow.

I claim:

1. In a hydraulic staging jack having a hydraulic cylinder axially adjustably fixed in a base with at least one flange of the base fitting in at least one groove of the cylinder, the cylinder having multiple axially spaced grooves which may be selectively engaged with said flange of the base to vary the axial position of the cylinder in the base, the improvement wherein:

said flange is formed on a shoe which seats in a seated position in said base and is axially moveable relative to said base out of said seated position such that lifting said shoe axially out of said seated position disengages said flange radially from said groove and lowering said shoe axially to said seated position with a groove aligned with said flange engages said flange radially in said groove.

2. The improvement of claim 1, wherein at least two flanges of said base are engaged in at least one groove of said cylinder, each said flange being formed on one of two shoes, said shoes moving radially away from one another when said shoes are moved axially out of said seated position and coming radially together to engage said flanges in said at least one groove of said cylinder when said shoes are moved axially into said seated position.

3. The improvement of claim 2, wherein said shoes are connected to one another so as to move together axially and be moveable relative to one another in a radial direction.

4. The improvement of claim 3, further comprising a handle fixed to one of said shoes for moving said shoes axially.

5. The improvement of claim 2, wherein said shoes seat against an axially facing surface of said base.

6. The improvement of claim 1, wherein said shoe has a side opposite from said flange and said side is angled in the axial direction.

7. The improvement of claim 6, wherein said base has an angled surface which mates with said shoe so as to move said shoe radially away from an axis of said base when said shoe is moved axially out of said said seated position.

8. The improvement of claim 1, wherein said groove is semi-circular in cross-section.

9. The improvement of claim 8, wherein said flange is semi-circular in cross-section.

* * * * *